US005335434A

United States Patent [19]

Shultz et al.

[11] Patent Number: 5,335,434

[45] Date of Patent: Aug. 9, 1994

[54] PICTURE FRAME

[75] Inventors: Julius Shultz, North White Plains, N.Y.; Joseph Nicolay, South Plainfield, N.J.

[73] Assignee: Dax Manufacturers, Inc., Orangeburg, N.Y.

[21] Appl. No.: 756,522

[22] Filed: Sep. 9, 1991

[51] Int. Cl.[5] ..... G09F 1/12

[52] U.S. Cl. ..... 40/156; 40/152.1

[58] Field of Search ..... 40/156, 152.1, 152, 40/155

[56] References Cited

U.S. PATENT DOCUMENTS

| | | | |
|---|---|---|---|
| 3,613,280 | 10/1971 | Tuchinsky et al. | 40/155 |
| 3,899,844 | 8/1975 | Munn | 40/152 |
| 4,422,613 | 12/1983 | Gray et al. | 40/152.1 |
| 4,509,278 | 4/1985 | Astolfi | 40/156 |
| 4,672,758 | 6/1987 | LeCarpentier et al. | 40/152.1 |
| 4,704,814 | 11/1987 | Astolfi | 40/152.1 |
| 4,707,937 | 11/1989 | Astolfi | 40/152.1 |
| 4,776,117 | 10/1988 | Astolfi | 40/152.1 |
| 4,790,089 | 12/1988 | Astolfi | 40/156 |
| 4,859,112 | 8/1989 | Nakayama | 40/152 |
| 4,974,351 | 12/1990 | Ghislanzoni | 40/156 |

FOREIGN PATENT DOCUMENTS

| | | | |
|---|---|---|---|
| 3805603 | 9/1989 | Fed. Rep. of Germany | 40/156 |
| 2057870 | 4/1981 | United Kingdom | 40/156 |

*Primary Examiner*—Kenneth J. Dorner
*Assistant Examiner*—C. Davis
*Attorney, Agent, or Firm*—Schweitzer Cornman & Gross

[57] ABSTRACT

A new and improved wood frame construction in which the artwork may be end-loaded into a frame in which three of the four sides are permanently interconnected with the fourth side being removable to accommodate the loading of the artwork into the frame. In particular the new and improved frame construction has a very narrow front profile making the frame quite attractive and comparatively unique in its appearance.

4 Claims, 4 Drawing Sheets

FIG. 1
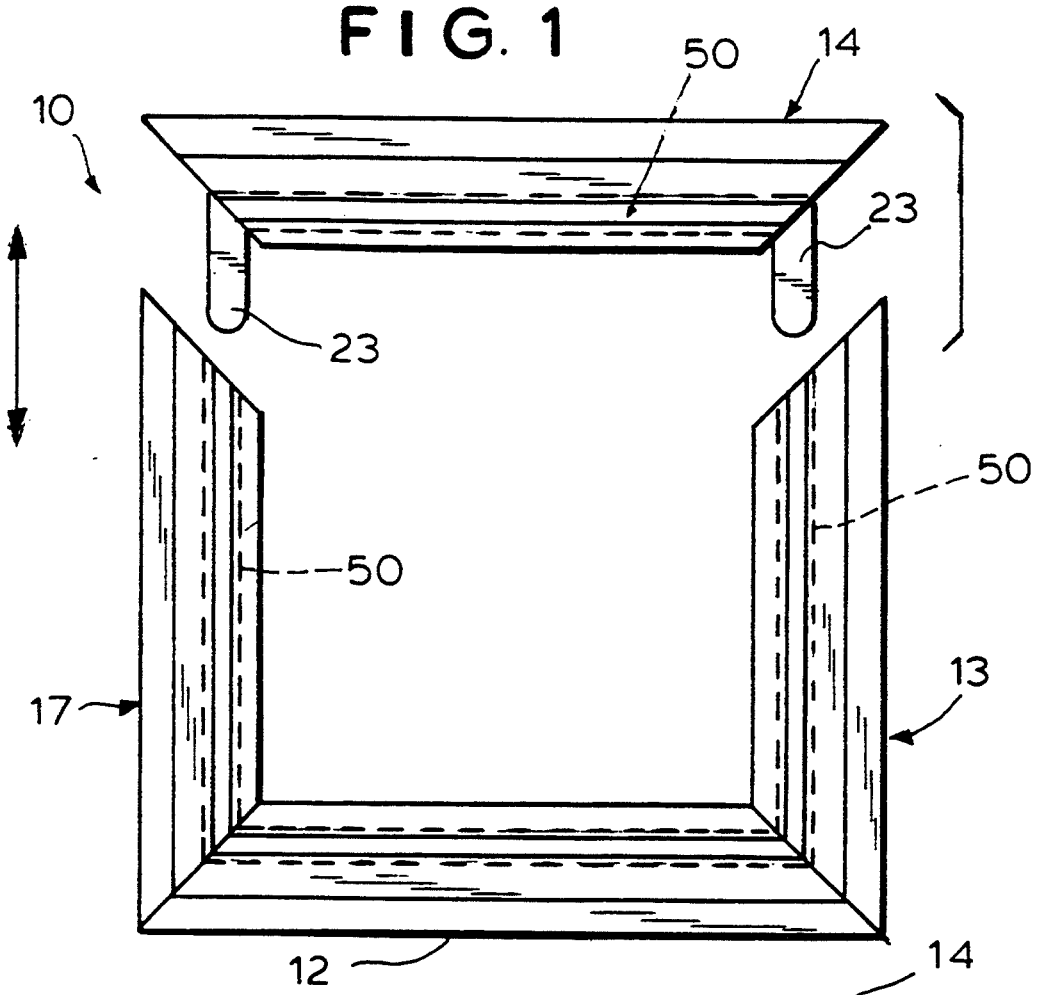
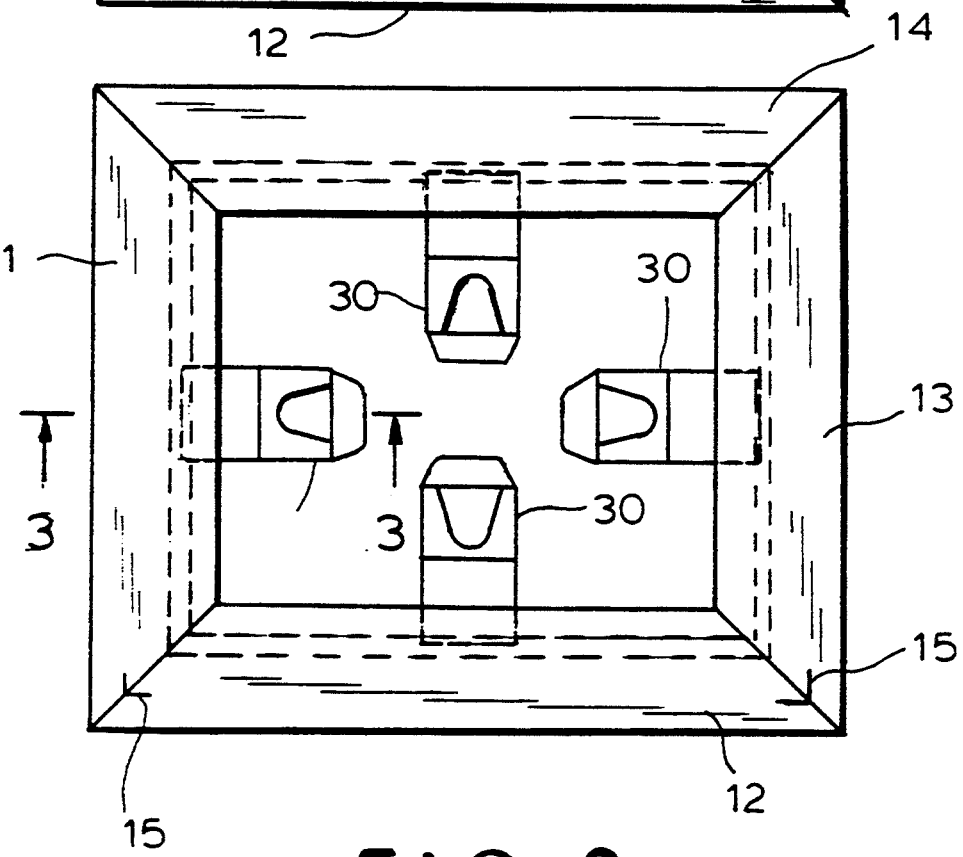
FIG. 2

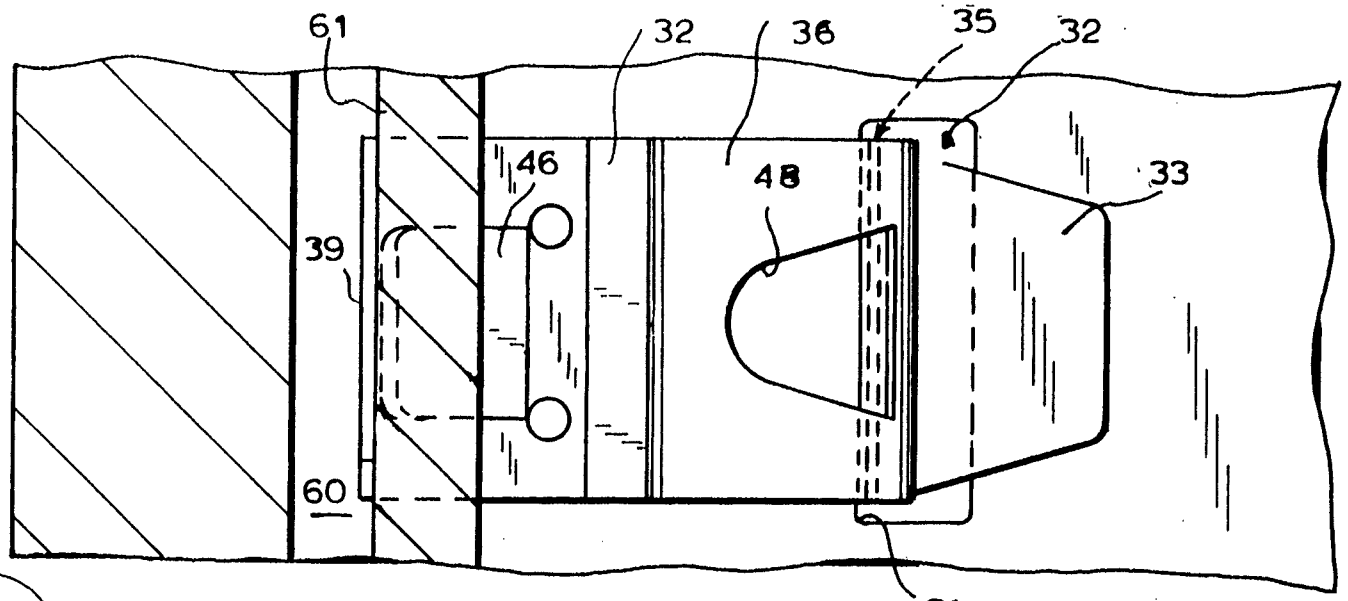
FIG. 4
FIG. 3
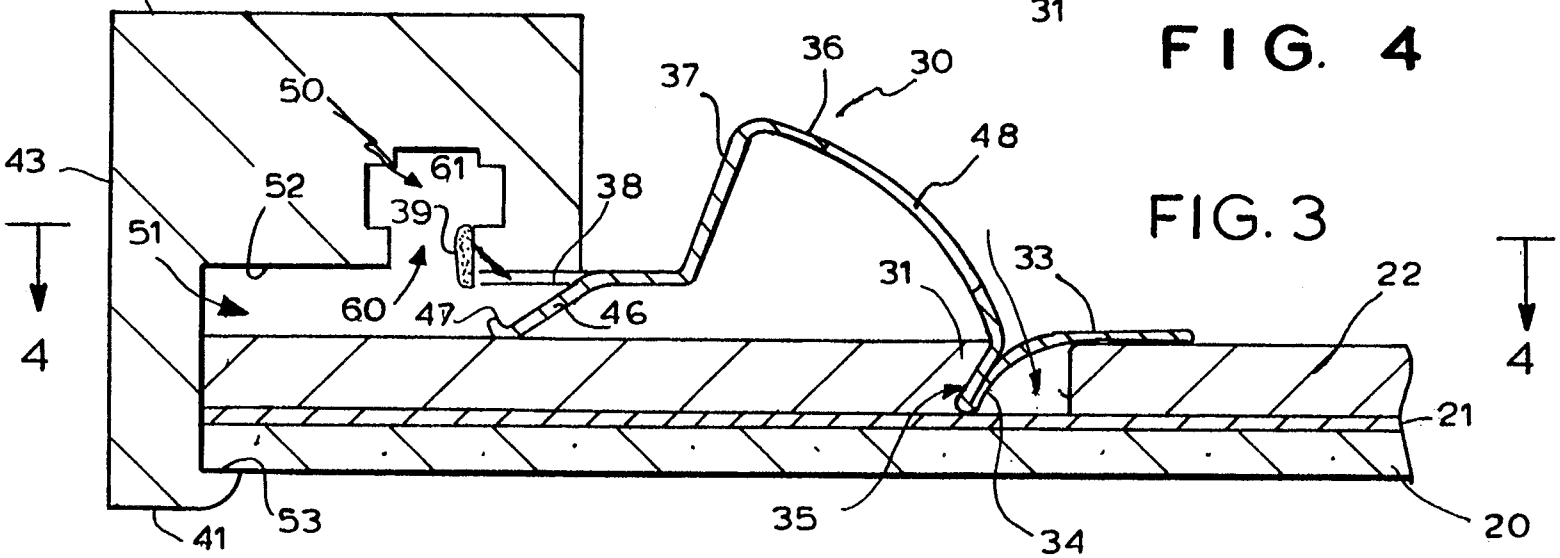

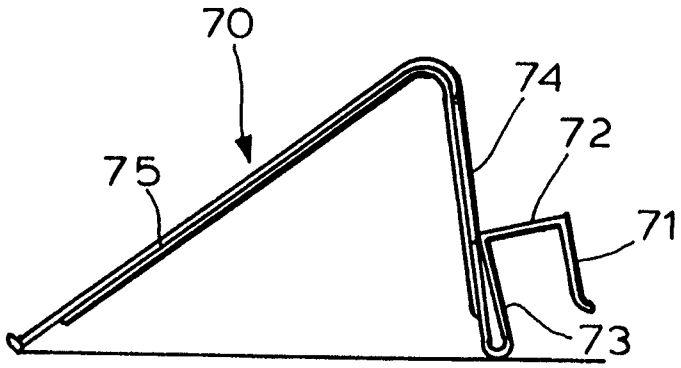
FIG. 7
FIG. 6
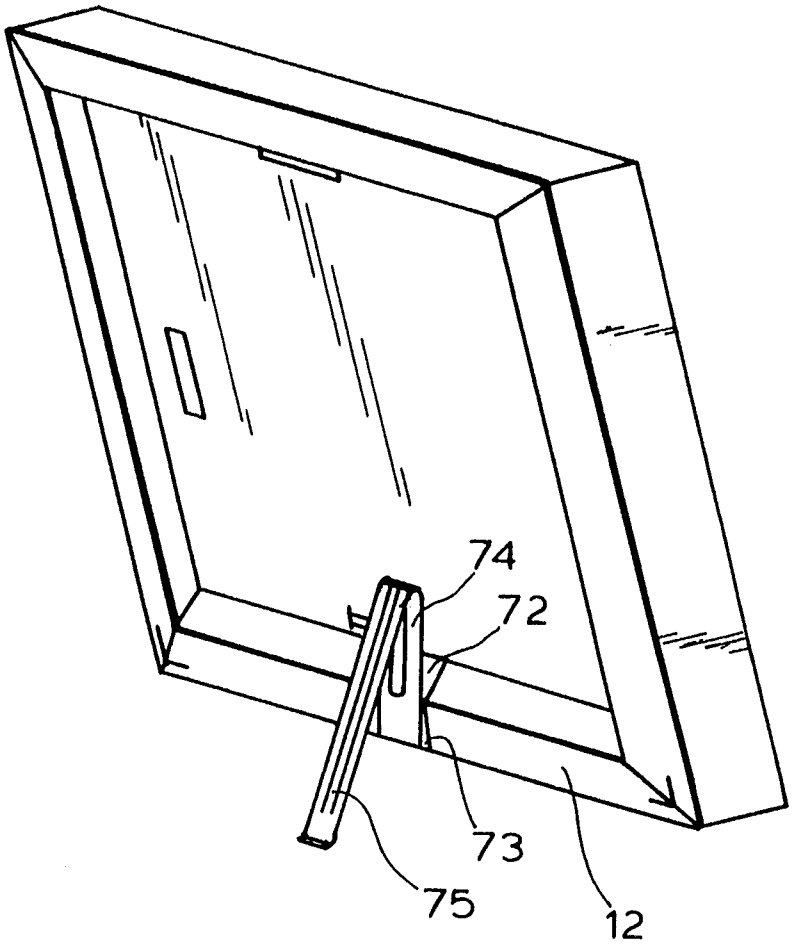

PICTURE FRAME

BACKGROUND OF THE INVENTION

The present invention relates to picture frames of the type which comprise an external frame of rectangular shape in which the art or other material to be displayed is sandwiched between a backing board and a glass plate secured to the frame. More specifically, the present invention is directed to a new and improved frame construction in which the artwork may be end-loaded into a frame in which three of the four sides are permanently interconnected with the fourth side being removable to accommodate the loading of the artwork into the frame. In particular the new and improved frame construction has a very narrow front profile making the frame quite attractive and unique in its appearance for ready-made frames.

SUMMARY OF THE PRESENT INVENTION

The frame of the present invention is assembled from a frame molding element or rail of plastic, wood, or an aluminum extrusion having specially configured receiving and assembly grooves respectively to receive the artwork, backing board and glass as well as to accommodate the hardware necessary to align and stabilize the finished frame. The frame is designed for selective partial disassembly of one of the four frame rails to accommodate end loading.

More particularly, the frame rails are mitered and assembled by gluing and nailing to form a U-shaped, three-sided frame. The fourth rail is non-permanently attached to the three other frame rails to complete the frame by means of L-shaped corner pieces which align and stabilize the fourth frame rail with the remainder of the frame. In accordance with the invention, the backing board is locked into association with the four frame rails by means of new and improved locking/biasing resilient clips which engage locking slots formed in the backing board and a locking wall formed in the frame rails.

As a further feature of the invention, the new and improved frame may be provided with an easel clip which engages a lower edge to provide a simple easel when the frame is to be displayed on a horizontal surface. The new and improved clips have hanger holes formed therein to accommodate hanging the frame for vertical display on a wall through a conventional nail or picture hook.

For a more complete understanding of the principles of the present invention and a better appreciation of its attendant advantages, reference should be made to the accompanying drawings taken in conjunction with the following detailed description.

DESCRIPTION OF THE DRAWINGS

FIG. 1 is a front elevational view of the new frame showing three of the frame rails connected with the fourth rail being disassembled therefrom;

FIG. 2 is a rear elevational view of the assembled frame showing the fourth rail assembled to the three permanently connected rails and the clips interconnecting the backing board with the frame;

FIG. 3 is an enlarged cross-sectional view showing the interrelationship of the elements of the frame including the new locking/biasing clip engaging a wall in the frame rail and a locking slot in the backing board;

FIG. 4 is a plan view taken along line 4—4 of FIG. 3;

FIG. 6 is a perspective view of an assembled frame with the easel clip attached to the bottom rear frame rail thereof; and FIG. 7 is a side elevational view of the easel clip of the present invention.

DESCRIPTION OF A PREFERRED EMBODIMENT

Figure 5:
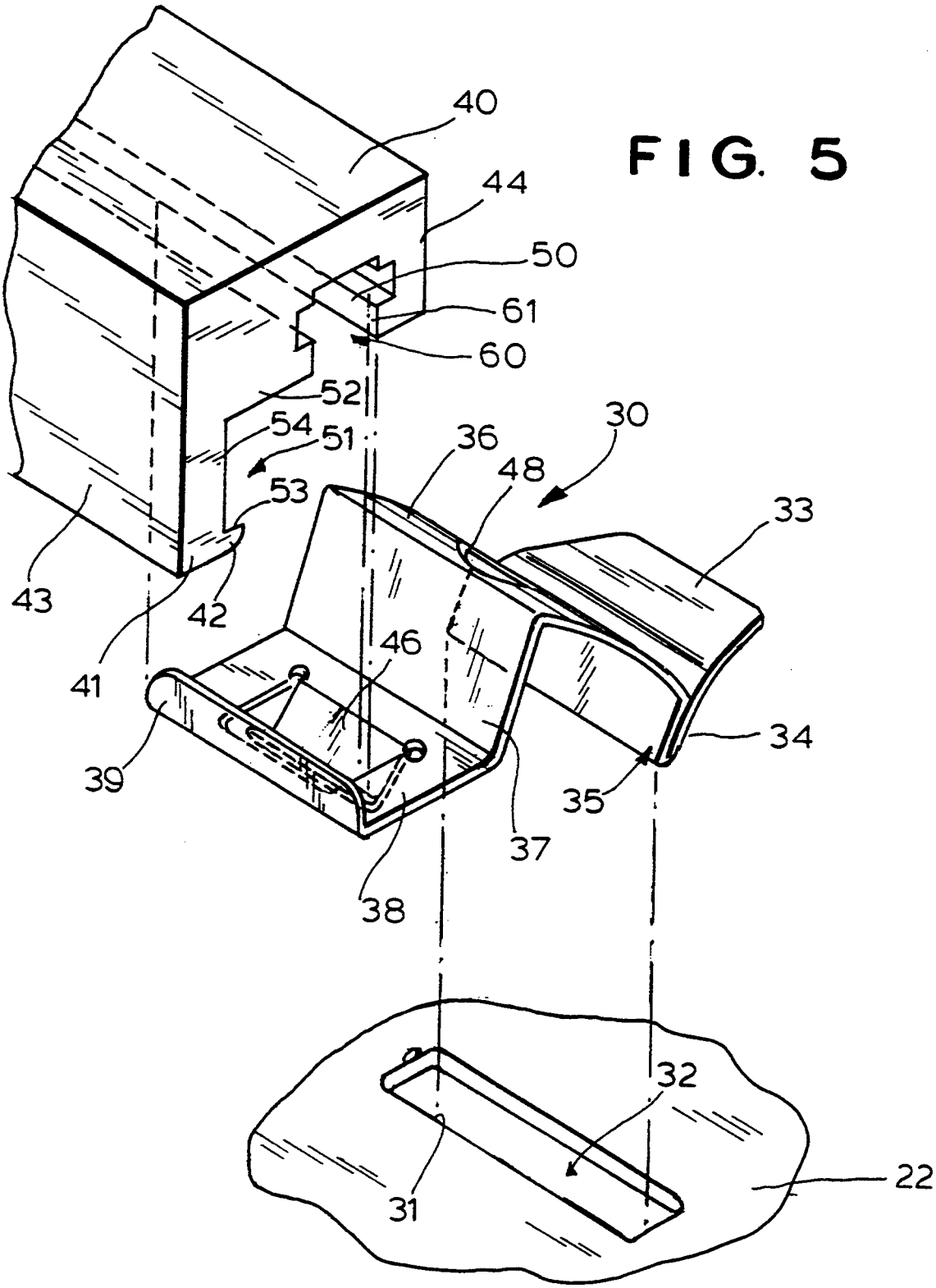
FIG. 5 is an exploded perspective view showing the interrelationship of the backing board, locking/biasing clip, and locking slot of the frame rail in accordance with the principles of the invention.

Referring now to FIG. 1, the frame 10 of the present invention comprises four frame rail elements, 11, 12, 13 and 14 which are mitered at their ends and interconnected to form a rectangular picture frame. As shown in FIG. 2, frame rails 11 and 13 are connected at their lower end portions to the frame rail 12 by angular nails 15 as well as by adhesive (not shown). The three rails 11, 12, 13 form an open U-shaped frame as shown in FIG. 1 which may be completely closed by the assembly of frame rail 14 thereto.

In accordance with the invention, however, the frame rail 14 is not connected to the remaining frame rail portions until the artwork 21 which is to be framed has been loaded into the frame along with a glass front plate 20, and a backing board 22 as shown in FIG. 3. When the artwork, backing board and glass have been slid through the open end into the U-shaped frame, the remaining frame rail 14 is located against the frame rails 11 and 13 (as shown in FIG. 2) by means of L-shaped metal guides 23 as will be described in detail hereinafter. The entire frame assembly is securely held together with the artwork 21 firmly pressed against the glass front plate 20 by means of four special locking/biasing clips 30 which engage a vertical front wall 31 of four rectangular locking slots 32 formed in the backing board 22.

With reference to FIGS. 3 and 5, the unique configuration and operation of the locking/biasing clips 30 may be fully appreciated. The J-shaped frame rails 11, 12, 13, 14 from which the rectangular frame 10 is constructed all are uniform in cross-section and may be mitered to size from wooden rails which are appropriately milled or from plastic or aluminum extrusions so as to have a flat rear wall portion 40 which is comparatively broad or wide and a parallel but very narrow front wall portion 41 (approx. 3/16 inches) terminating in a rounded or beveled portion 42 to enhance the appearance of the frame. The front and rear wall portions 40, 41 are connected by a perpendicular flat outer side wall portion 43, the portions 40, 43, and 41 generally forming a J-shaped profile. The frame rail has an inner wall portion 44 which is parallel to the outer side wall portion 43.

In accordance with the principles of the invention an elongated narrow assembly groove 50 extends for the length of the rear portion. A wide receiving groove 51 extends for the length of each rail having rear surfaces 52 and very shallow front surfaces 53 (appriox. 0.090 inches) parallel to the rear and front surfaces 40, 41 of the frame rail member. The surfaces 52, 53 are interconnected by a perpendicular surface 54 parallel to the side edge 43. The width of the assembly groove 50 is slightly greater than the width of the L-shaped members 23, as will be understood, so as to snugly accommodate the L-shaped members 23, as will be understood so as to snugly accommodate the L-shaped connecting members therein during the assembly and/or disassembly of the frame rail 14 from the frame rails 11 and 13. The slot 60 is formed in the frame rail and communicates from the surface 52 into the slot 50 as shown in FIG. 5. The slot 60 has a locking wall 61 perpendicular to the plane of the backing board 22 which is adapted to engage the locking clip 30 as will be described and better understood hereinafter.

The new and improved locking/biasing clip 30 is formed from resilient spring steel. The clip 30 includes a finger lift-tab portion 33 the bottom portion 34 of which is folded back upon itself to form a locking tongue 35. An arcuate central portion 36 connects the locking tongue 35 with a vertical leg portion 37 which terminates in a locking lip 39. Depending from the plate 38 and formed by a U-shaped cut 9 is a biasing spring tab 46 having a rounded end portions 47 as shown best in FIG. 4. A hanger opening 48 is formed in the arcuate plate member 36.

With the configuration of the clip 30 described as above the new and improved frame may be readily assembled and disassembled as follows: the glass front plate 20 with the artwork 21 (with a mat if desired) and backing board 22, superimposed as shown in FIG. 3, are slid into the open end of the U-shaped frame shown in FIG. 1 with the glass, artwork, and backing board disposed in the receiving groove 51 with the glass directly contacting the edge 53 of the groove 50 as shown in FIG. 3. The open end of the frame is then closed by placing the remaining rail 14 against the rails 11 and 13 with the L-shaped locating members 23 disposed in the grooves 50 as shown. The members 23 guide, square and rigidify the connection.

The clips 30 are then placed in locking relationship with the frame rails 11–14 and the backing board 22 by engaging the locking lips 39 against the locking walls 61 of the frame rails while placing the locking tongues 35 against the front walls 31 of each of the locking slots 32 formed in the backing board 22, as clearly illustrated in FIGS. 3, 4 and 5. This will firmly lock the frame rails 11–14 to the backing board 22 and rigidify the entire frame assembly while enabling the spring tabs 46 to bias the sandwich of backing board 22, artwork 21 and glass 20 forwardly of the frame and against the groove wall 53 and front face of the frame as shown best in FIG. 3. The tabs 46 accommodate receiving artwork/mat "packages" of varying thicknesses.

The completed frame 10 may be hung on the wall through the hanger opening 48 in accordance with the principles of the invention or alternatively the frame may be displayed as an easel by the use of the easel clip 70 shown in FIG. 7. In either case, the backing board supports the weight of the glass and artwork through the action of the clips 30 and rails 11–14. The easel clip 70 includes a U-shaped inner portion having legs 71, 72 and 73 configured so as to engage the bottom frame rail 12 as shown in FIG. 6. The leg 73 is bent back upon itself and connected to an upwardly extending canted leg 74 which itself is then bent downwardly to a leg 75 as shown in FIG. 7. Advantageously the width "W" of the easel clip member 70 as shown in FIG. 6 is slightly less than the depth "D" of the frame rail from its rear edge to the surface of backing board 22. This enables a complete frame assembly to be shipped with a disassembled easel member packaged loosely within the contours of the frame itself without projecting outwardly from the peripheral portions thereof as will be appreciated.

The frame of the present invention lends itself to a mass production of ready-made frames in a variety of standard sizes and provides a frame which may be readily assembled and disassembled easily by simply removing one section of rail and several clips, without any tools whatever and without any need of special skills. The design provides a very strong, attractive, narrow profile frame which may be easily loaded from one end.

While the present invention has been described with reference to a particular preferred embodiment, it will be appreciated that variations may be made therein without departing from the spirit and the scope of the invention as defined hereinafter in the claims.

We claim:

1. A rectangular picture frame having four elongated mitered wood frame rails (11, 12, 13, 14) connected together to define a closed picture frame with a narrow front profile for supporting superposed glass, artwork and backing board for display in which:

(a) each of said wood frame rails (11, 12, 13, 14) has a generally J-shaped profile defined by a wide rear wall portion (40) connected at right angles to a side wall portion (43) connected at right angles to a short narrow front wall portion (41);

(b) each frame rail having an elongated receiving groove (51) formed therein having a front groove wall (53) parallel to said front wall portion (41) of the picture frame, a rear groove wall (52) parallel to said rear wall portion (40) of the picture frame; and a side groove wall (54) parallel to an outer surface of the side wall portion (43) extending between the front groove wall (53) and rear groove wall (52);

(c) said rear wall portion (40) of said frame rail having an elongated narrow assembly groove (50) formed therein and having a perpendicular slot (60) communicating with an inner face of said frame rail, said slot (60) forming a locking wall (61);

(d) three of said frame rail portions (11, 12, 13) being permanently interconnected at the rear wall portions (40) by adhesive and angular nail elements (15) to form an open U-shaped frame element;

(e) a fourth frame rail means (14) being removably connected to said U-shaped frame element;

(f) a flat L-shaped guide member (23) disposed at each end of said fourth rail (14) in said assembly groove (50) and adapted to be inserted in the assembly groove (50) of rails (11, 13) of the open U-shaped frame element;

(g) said U-shaped frame element having an end-loadable circumscribing groove formed by said elongated receiving grooves (51) in said side wall portion (43) of said frame rails;

(h) a rectangular glass plate (20) and a rectangular backing board (22) each having side edges of which are slidable into said circumscribing groove through the open end of said U-shaped frame;

(i) said backing board (22) having four locking slots (32), each locking slot being formed proximate to each of the edges of said board at generally central portions thereof; and (j) resilient spring locking/biasing clip (30) engaging each of said four locking slots in said backing board at one end of the clip and engaging said locking wall (61) in the assembly groove (50) of said frame rail at the other end of the clips; one of said clips locking said fourth framing rail to the backing board; the other clips rigidifying the entire frame and urging the backing board toward said glass plate at the front wall portion of said frame to display any artwork interposed between said glass plate and said backing board.

2. The picture frame of claim 1 in which:

(a) each of said locking clips is formed from a strip of resilient spring steel preformed to include a canted locking tongue adapted to be seated in said locking slots on the backing board and to have a locking lip at its free end adapted to engage said locking wall (61) formed in the assembly groove (50) of the frame rail;

(b) each of said locking clips including a biasing tab means adapted to engage said backing board adjacent said frame rail to urge said backing board toward the front face of said frame in said receiving groove.

3. The picture frame of claim 2 further characterized in that:

(a) at least two of said biasing/locking clips include picture hanger openings defined therein to accommodate hanging of the frame.

4. The picture frame of claim 1 which further includes:

(a) a one-piece easel member comprising a supporting leg and a frame engaging leg adapted to engage said picture frame and support it at a canted relation with a supporting surface.

* * * * *